US007182158B2

(12) United States Patent
Völkel

(10) Patent No.: US 7,182,158 B2
(45) Date of Patent: Feb. 27, 2007

(54) DRILLING DEVICE COMPRISING A ROTATIONAL DRIVE

(75) Inventor: Gerhard Völkel, Erndtebrück (DE)

(73) Assignee: Tracto-Technik GmbH (DE)

( * ) Notice: Subject to any disclaimer, the term of this patent is extended or adjusted under 35 U.S.C. 154(b) by 247 days.

(21) Appl. No.: 10/469,319

(22) PCT Filed: Feb. 26, 2002

(86) PCT No.: PCT/EP02/02021

§ 371 (c)(1),
(2), (4) Date: Jan. 27, 2004

(87) PCT Pub. No.: WO02/070858

PCT Pub. Date: Sep. 12, 2002

(65) Prior Publication Data

US 2004/0108144 A1 Jun. 10, 2004

(30) Foreign Application Priority Data

Mar. 3, 2001 (DE) ..... 101 10 399

(51) Int. Cl.
*E21B 17/02* (2006.01)

(52) U.S. Cl. ..... 175/320; 166/242.6; 464/19; 464/97; 464/114

(58) Field of Classification Search ..... 175/320; 464/97, 18, 179, 182, 183, 180, 19, 114; 166/242.1, 242.6
See application file for complete search history.

(56) References Cited

U.S. PATENT DOCUMENTS 1,547,759 A 7/1925 Journeay
2,446,964 A * 8/1948 Stone ..... 464/97
2,641,444 A * 6/1953 Moon ..... 166/381
2,953,352 A * 9/1960 Webb ..... 267/125
3,998,479 A * 12/1976 Bishop ..... 285/123.3
4,067,596 A * 1/1978 Kellner et al. ..... 285/123.3
5,322,391 A 6/1994 Fisk
5,439,323 A * 8/1995 Nance ..... 405/195.1

FOREIGN PATENT DOCUMENTS

DE 1 179 889 10/1964
DE 43 36 245 A1 4/1995
DE 199 12 150 A1 9/2000
WO WO 94/20726 * 9/1994
WO PCT/EP02/02021 6/2002
WO PCT/EP02/02021 11/2002

* cited by examiner

*Primary Examiner*—Kenneth Thompson
(74) *Attorney, Agent, or Firm*—Cook, Alex, McFarron, Manzo, Cummings & Mehler Ltd.

(57) ABSTRACT

In a drilling device with a drive unit for rotation and advance the rod assembly has a plurality of pipe sections interconnected by means of plug-type connections torque proof in both directions. A tension rod protrudes through the interior of the rod assembling. The pipe sections are braced among each other with aid of the tension rod. The tension rod can be made of pipe sections or of a tension rope and allows the possibility, that the rope assembly can be moved in its integrity against the drilling direction.

14 Claims, 7 Drawing Sheets

DRILLING DEVICE COMPRISING A ROTATIONAL DRIVE

CROSS-REFERENCE

This is a national stage application of International Application No. PCT/EP02/02021, filed Feb. 26, 2002. The invention relates to a drilling device with a drive unit for advance and rotation for a rod assembly of a plurality of interconnected pipe sections and claims the priority of the German patent application 101 10 399.9, the contents of which are incorporated by reference.

STATEMENT OF FEDERAL SPONSORSHIP

Not Applicable

PARTIES OF JOINT RESEARCH AGREEMENT

Not Applicable

BACKGROUND

With these kinds of drilling devices, which may also comprise an impact drive unit and/or a vibration drive unit apart from the drive unit for advance and rotation, the rod assembly is used for the transmission of pushing forces and torque onto the drilling tool as well as for the transmission of pulling forces when taking out the rod assembly out of a drilling hole against the drilling direction, as normally done. Furthermore drilling rod assemblies for wet drilling are used to transport drilling fluid in direction of the drilling tool e.g. for the hydraulic mining of the soil. Drilling rod assemblies thus are subject to large static and dynamic load and thus require connections for the single pipe sections, which can cope with these loads and are, if necessary, liquid tight.

In practical use screwed connections are normally used as rod connections. These do however make time consuming screwing processes, often with use of special rod screwing devices, necessary on the one hand and are especially extremely sensitive to soiling and mechanical damage. Additionally, screwed drilling rod assemblies allow only one direction of rotation during drilling, as unscrewing of the connection would result otherwise. Even if the time effort for applying the screwing device, the actual screwing and the withdrawal of the screwing device per rod section is small, the related stop periods add up substantially with increasing rod assembly or drilling length.

BRIEF SUMMARY

The invention is thus directed to a drilling rod assembly of multiple sections, which sections can be interconnected and taken apart in a time-saving manner.

This is possible with a drilling device according to the invention, where the pipe sections are braced among each others by means of a tension rod situated inside the pipe. The tension rod allows to do without a screwing connection and instead to do with a simple plug-type connection, e.g. a positive fit plug type connection. Such a plug-type connection can be made of pipe sections inserted into each other in a sleeve manner.

The tension rod can be made of massive sections or can also be made of pipe sections (inner pipe sections). In this manner it is possible to transport the drilling fluid through a pipe type tension rod to the drilling head and to transport the drilling fluid back through a ring shaped channel between the tension rod (inner rod assembly) and the outer rod assembly or to work with a driving fluid for a MUD-motor as well as a drilling fluid separately therefrom.

The pipe sections of the outer and/or the inner rod assembly or the tension rod respectively can be interconnected with positive fit, e.g. by means of bayonet catches, which allow a fast and secure connection and separation of the pipe sections.

It can be of advantage, if the inner pipe sections have a receiver at one end with an opening for inserting there-through at least one lockin stop. The other pipe end is then provided with at least one corresponding locking stop, which for locking and unlocking only needs to be turned through 90°.

In the proximity of the locking stop a carrier stop can be arranged, which co-operates with a corresponding stop of the respective outer pipe section. In a like manner a carrier stop for the locking stop can be arranged in the proximity of the receiver of the inner pipe sections, which also corresponds with a stop of the respective outer pipe section.

To allow this co-operation, the outer pipe sections can be provided with a inner collar, which has a longitudinal slit for inserting there-through the carrier stop on the inner pipe section. The inner collar can pass into a ring groove for the carrier stop.

Since the section of the outer pipe and the tension rod can be interconnected without screwing, they should be provided with at least one key surface to create a torque proof connection in both directions and to allow an easy and fast locking for the tension rod by means of a key.

The tension rod can also be made of separate rope sections, which can be interconnected by means of a connector having a hook and a ring. In this case at least one carrier stop can also be provided in the proximity of the hook and/or at least one carrier stop can be provided in the proximity of the ring also. These stops then also co-operated with slit inner collars of the outer pipe sections.

Preferably the carrier stops are arranged in pairs in positions opposing each other.

The invention will be described in detail by means of the drawings, which only show possible embodiments. In the drawings

DETAILED DESCRIPTION OF THE EMBODIMENTS

Figure 1:
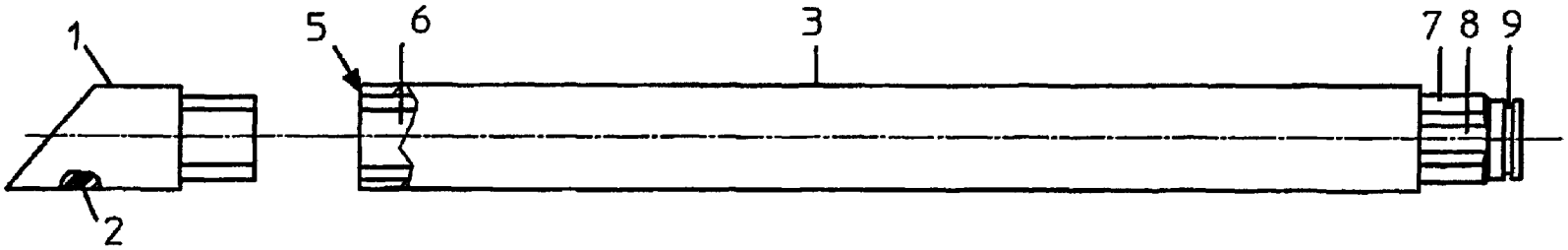
FIG. 1 shows an outer pipe section.

The drilling rod assembly is essentially made of a drilling head 1 with nozzles 2 for a drilling fluid as well as inner sections 4. The outer pipe sections 3 have a sleeve 5 with at least one key surface 6 at one end as well as a pivot 7 at the other end with at least one corresponding key surface 8 as well as a ring grove 9 for a seal (not shown).

Figure 2:
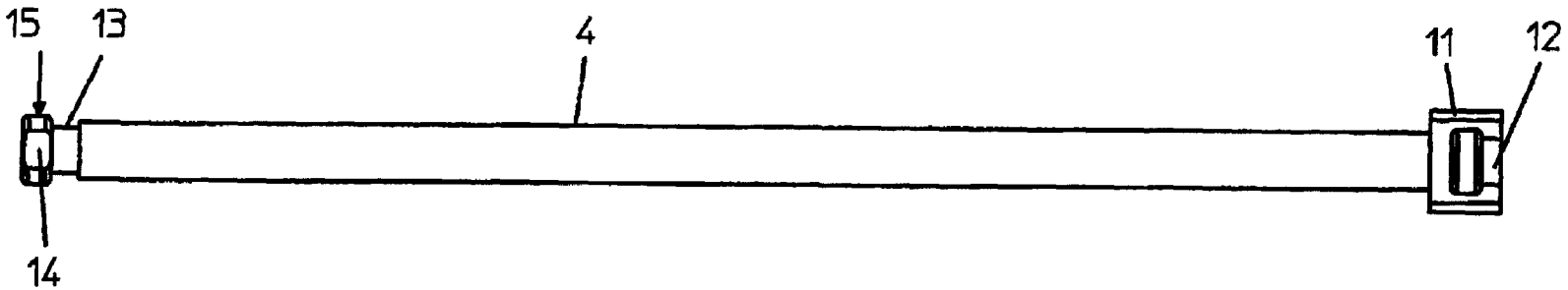
FIG. 2 shows a inner section in the form of a massive rod.

The inner section 4 is made of a massive rod (FIG. 2) and also has a sleeve 11 at one end with at least one key surface 12 and a pivot 13 at the other end with at least one corresponding key surface 14 as well as locking stops 15.

Figure 4:
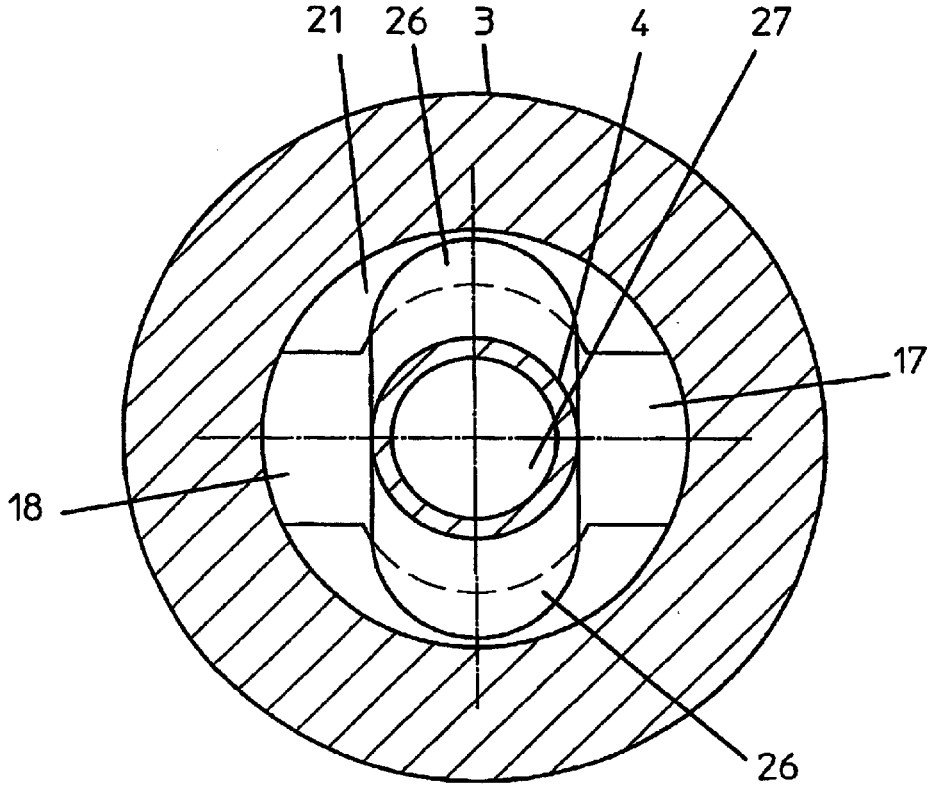
FIG. 4 shows a rod assembly cross-section along the line IV—IV in FIG. 3.

The outer pipe section 3 furthermore has an inner collar 16 with two longitudinal slits opposing one another, which cross section corresponds to the outline of the carrier stops 19 at the rearward end of a pipe type inner section 4 and—like shown in FIG. 4—are situated rotated by 90° with respect to the carrier stops. In proximity to the inner collar 16 is a inner surface grove 20 of the outer pipe sections 3, into which the carrier stops 19 mesh in the coupled state of the two pipe sections 3, 4. Furthermore the front end of the outer pipe section 3 has an inner collar 21, which, similar to the inner collar 16, has two opposing longitudinal slits 17, 18 (FIG. 4).

Figure 3:
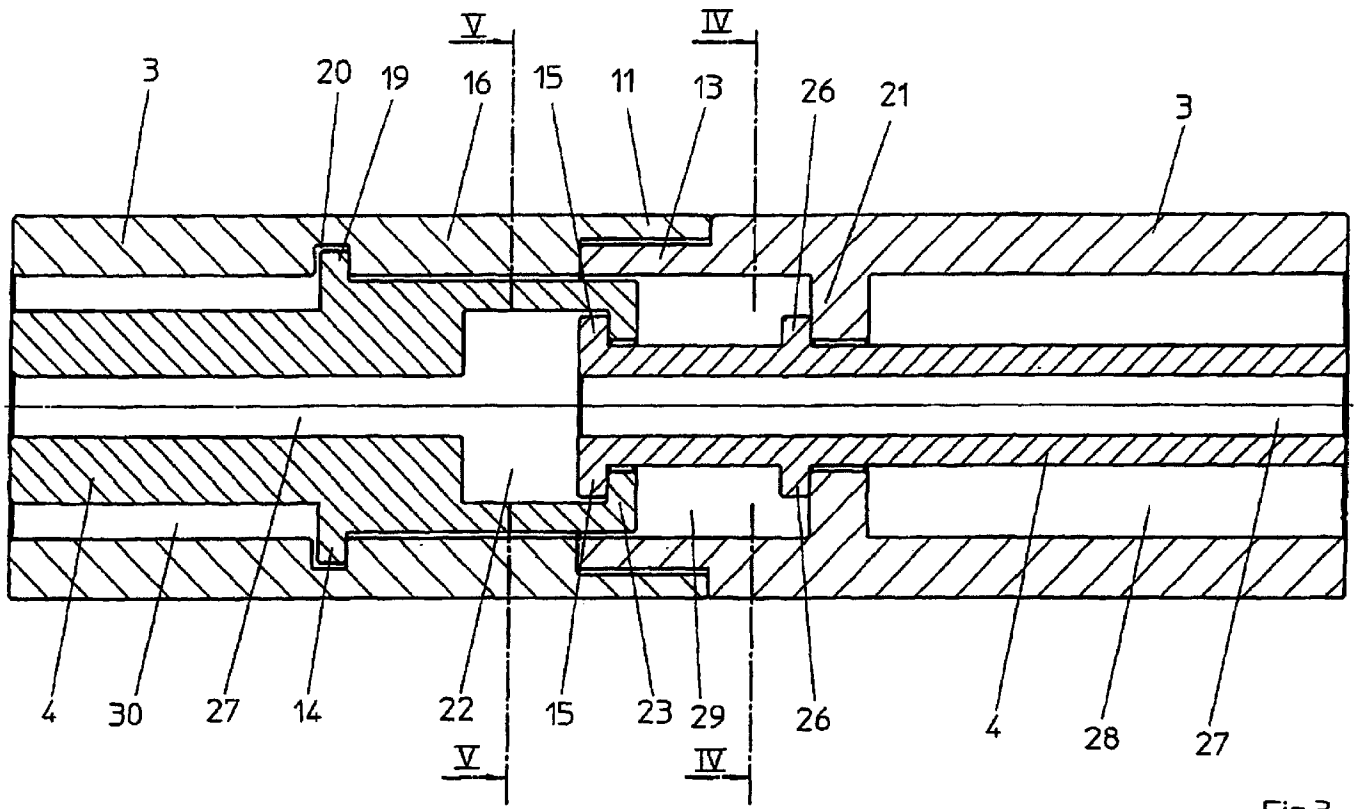
FIG. 3 shows two interconnected rod assembly sections of pipe sections according to FIGS. 1 and 2.
Figure 5:
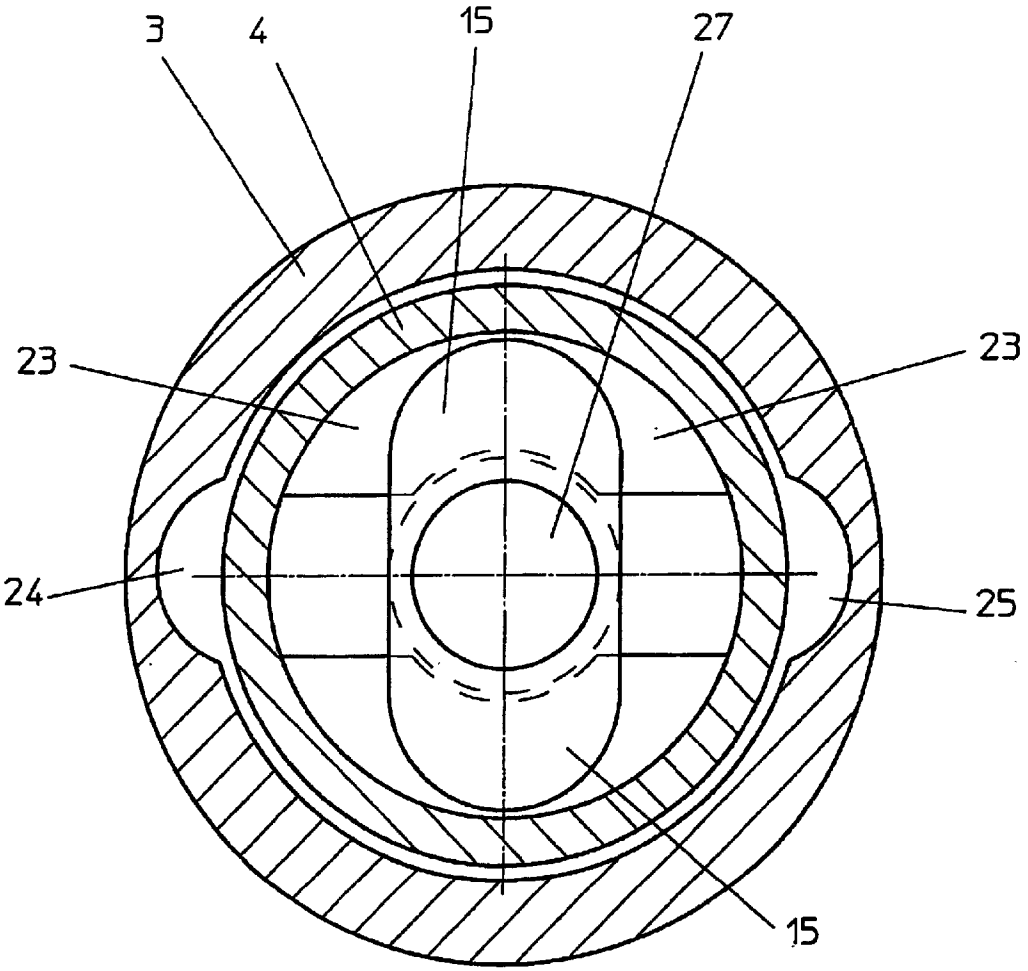
FIG. 5 shows a rod assembly cross section along the line V—V in FIG. 3.
Figure 6:
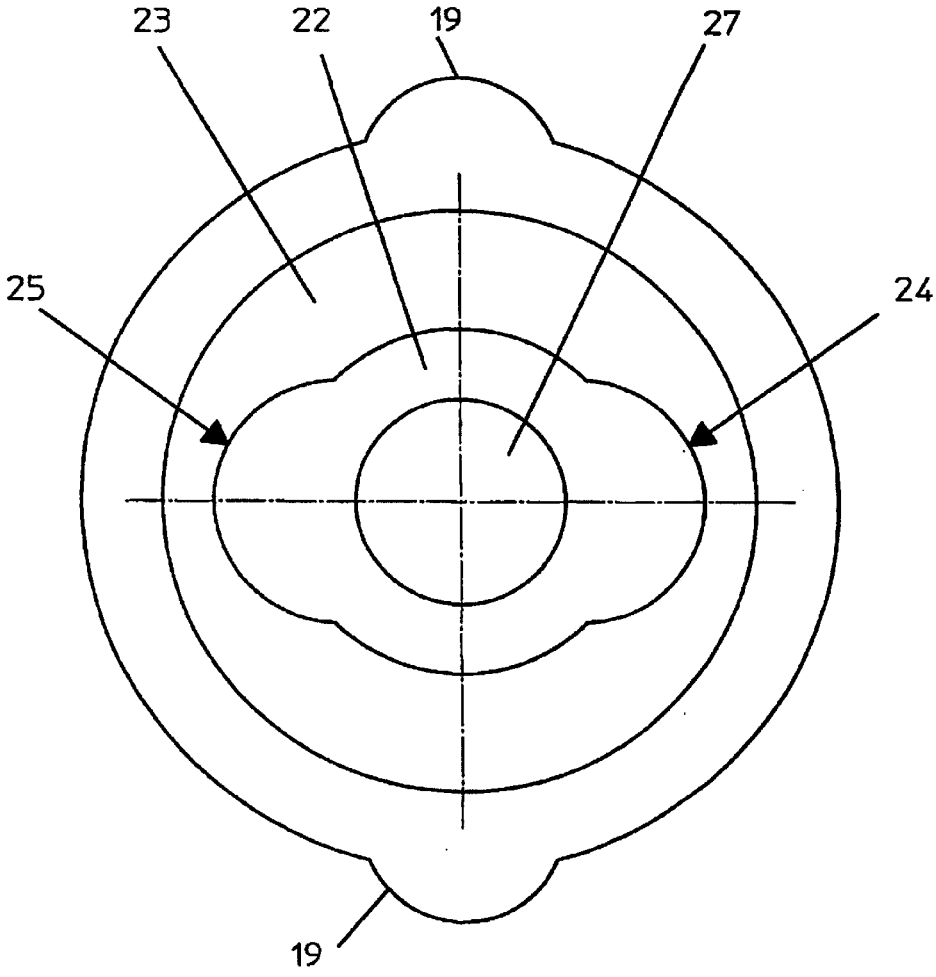
FIG. 6 shows the front view of a rearward inner pipe section and FIG. 7 shows two pipe sections interconnected by means of a robe type tension rod.

The rearward end of the inner pipe section 4 is provided with a receiver 22 for the carrier stops 15 at the front end of the neighbouring inner pipe section 4. In a coupled state these carrier stops 15 are situated behind a band 23 at the rearward end of the inner pipe sections 4 shown left in FIG. 3 or the front respectively, which band 23 is provided with two opposing longitudinal slits 24, 25 (FIG. 5) for inserting the carrier stops 15. At the front end of the inner pipe sections 4 further carrier stops 26 are situated, which can be inserted through the longitudinal slits 17, 18 in the inner collar 21 of the outer pipe section 3 and which serve as locking for the two pipe sections 3, 4 after a 90°-turn together with the other carrier stops 15 on the inner pipe section 4 (FIG. 5).

In the coupled state, the rod assembly has a continuous inner boring 27 as well as a continuous channel of separate ring shape sections 28, 29, 30, which surround the inner pipe sections 4 and are interconnected by means of the longitudinal slits 17, 18; 24, 25. In this manner it is possible to transport one single fluid to and fro through the rod assembly or to transport two fluids separately from each other in direction of the drilling head.

The complementary key surfaces 6, 8 at the outer pipe sections 3, opposing each other in the coupled state, provide a torque proof plug-type connection 11, 13 in both directions between the outer pipe sections 3, 4. A further plug-type connection, torque proof in both turning directions, results in the coupled state from the complementary key surfaces 12, 14, also opposing each other, at the inner sections 4 of the tension rod embodiment according to FIG. 2.

The inner sections 4 are interconnected with the outer pipe sections 3 by means of the carrier stops 15 and the band 23 as well as the carrier stops 19, 26 and the inner collars 16, 21 in such a fashion, that the rods 3, 4 form a unit and can be pulled out of a drilling hole (to the right in FIG. 3) in one piece by means of the tension rod or inner rod assembly respectively being made of the inner pipe sections 4, although the outer pipe sections 3 are only interconnected by means of the plug type connections 11, 13.

Figure 7:
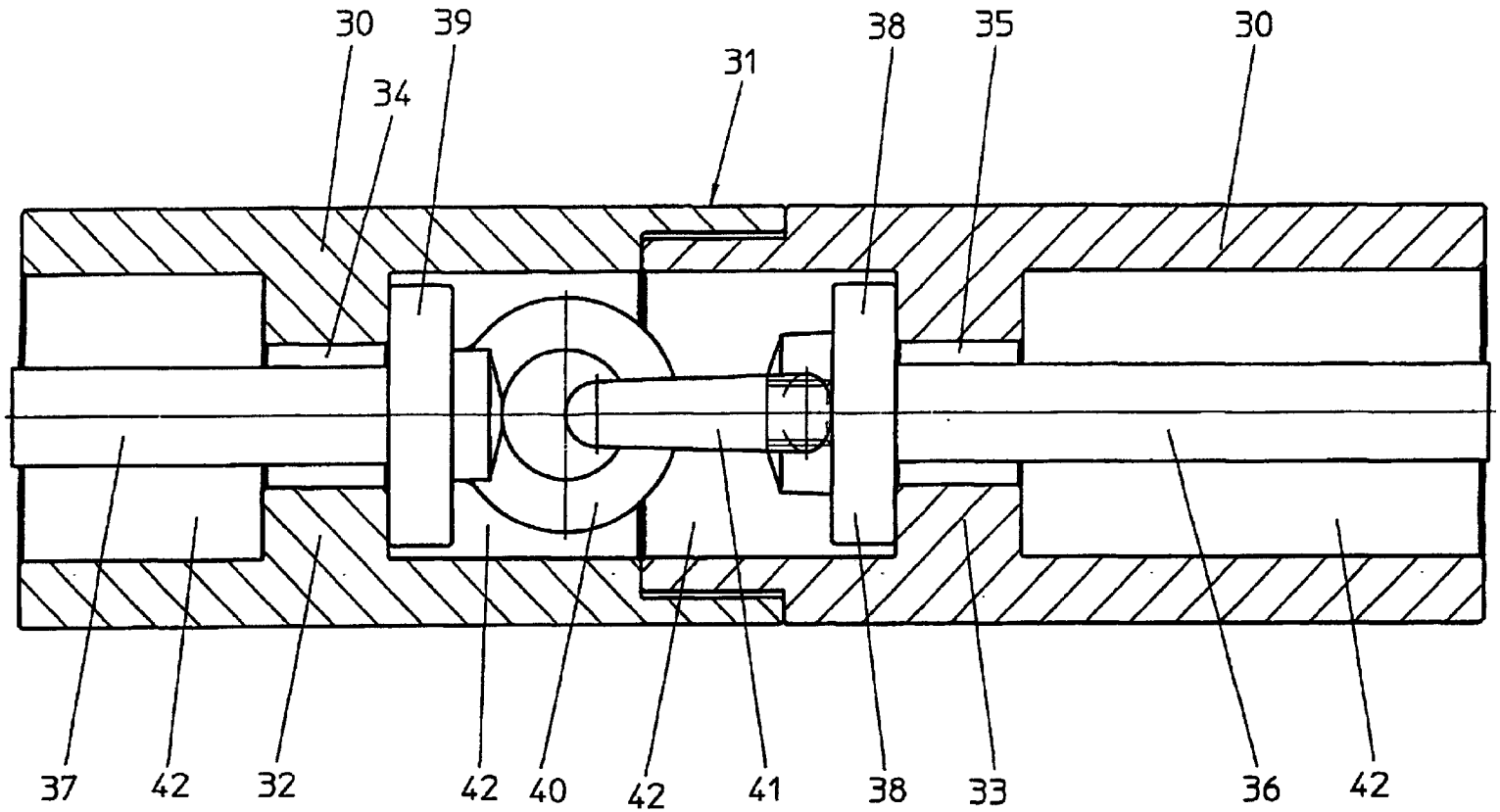

In the embodiment of FIG. 7 two outer pipe sections 20 are interconnected in a manner torque proof in both directions by means of a sleeve type plug type connection 31 like in the embodiments of FIGS. 1 to 5. The outer pipe sections 30 are provided with two inner collars 32, 33, which are provided in longitudinal slits 34, 35 like the inner collars 16, 20.

Within the rod assembly having outer pipe sections 30 a tension rod in form of separate rope sections 36, 37 protrudes, which are provided with carrier stops 38 at the front end and locking stops 39 at the rearward end as well as being interconnected by means of hooks 41 meshing with rings 40. The rearward locking stops 39 are provided to position the rope sections 36, 37 in co-operation with the carrier stops 38 situated at the front and to secure the rope sections 36, 37 against falling out of the pipe sections. With aid of the interconnected rope sections 36, 37 the outer pipe sections 30 can be braced together to form a uniform rod assembly torque proof in both directions. Additionally the rope 36, 37 allows the rod assembly to be pulled out of the drilling hole completely in both directions although only been connected by means of plug type connections 31.

The inside of the rod assembly of rod sections 30 is made of separate sections 42 which are in connection with each other by means of the mentioned longitudinal slits 34, 35 in the inner collars 32, 33. The rod assembly therefore can also be used for the transportation of a drilling or a driving liquid.

The rod assembly according to the invention can especially be used with a steerable drilling head, as described in U.S. Pat. No. 5,322,391, which content is herewith incorporated in this document.

The invention claimed is:

1. Device for producing earth drillings with a drive unit for rotation and advance for a rod assembly having a plurality of interconnected rod sections, characterized in that the rod sections are interconnected by means of bayonet connections and in a torque proof manner and are braced among each other by means of a tension rod situated in the interior of the rod sections.

2. Device according to claim 1, characterized in that the tension rod has separate sections.

3. Device according to claim 1, characterized in that the tension rod has inner pipe sections.

4. Device according to claim 2, characterized in that the sections of the tension rods are interconnected by means of a plug-type connection with positive fit.

5. Device according to claim 3, characterized in that the inner pipe sections have a receiver with an opening for carrier stops at one end.

6. Device according to claim 5, characterized in, that the other end of the inner pipe section has carrier stops.

7. Device according to claim 6, characterized in that in the proximity of the carrier stop of the inner pipe section a further carrier stop is positioned.

8. Device according to claim 5, characterized in that in the proximity of the receiver of the inner pipe section for the carrier stop on the inner pipe section carrier stops are situated.

9. Device according to claim 5, characterized in that the outer pipe sections are provided with an inner collar and that longitudinal slits for carrier stops are situated in the inner collar.

10. Device according to claim 9, characterized in that the inner collar passes into an inner surface groove.

11. Device according to claim 1, characterized in that the tension rod has rope sections.

12. Device according to claim 11, characterized in that the rope sections are interconnected by means of a connection of hooks and rings.

13. Device according to claim 12, characterized in that in the proximity of the hooks carrier stops are situated.

14. Device according to claim 12, characterized in that in the proximity of the ring locking stops are situated.

* * * * *